US006691323B2

(12) United States Patent
Widmer

(10) Patent No.: US 6,691,323 B2
(45) Date of Patent: Feb. 17, 2004

(54) VERSATILE GARMENT POCKET

(75) Inventor: Donald J. Widmer, San Diego, CA (US)

(73) Assignee: JT USA, LLC, Chula Vista, CA (US)

( * ) Notice: Subject to any disclaimer, the term of this patent is extended or adjusted under 35 U.S.C. 154(b) by 0 days.

(21) Appl. No.: 10/096,347

(22) Filed: Mar. 12, 2002

(65) Prior Publication Data

US 2003/0172442 A1 Sep. 18, 2003

(51) Int. Cl.[7] ..... A41D 27/20
(52) U.S. Cl. ..... 2/247
(58) Field of Search ..... 2/247, 249, 250, 2/251, 252–254, 94, 108, 227, 79, 115, 243.1, 69

(56) References Cited

U.S. PATENT DOCUMENTS 3,840,901 A * 10/1974 Eyster ..... 2/247
4,266,300 A * 5/1981 Partridge ..... 2/247
4,602,390 A * 7/1986 Morera et al. ..... 2/251
5,054,127 A * 10/1991 Zevchak ..... 2/247
5,737,775 A * 4/1998 Schwartz ..... 2/247
5,809,576 A * 9/1998 Huston et al. ..... 2/247
6,209,769 B1 * 4/2001 Seals et al. ..... 224/583

* cited by examiner

*Primary Examiner*—Tejash Patel
(74) *Attorney, Agent, or Firm*—Henri J. A. Charmasson; John D. Buchaca

(57) ABSTRACT

A garment pocket has a flap cover secured to the front piece by means of cooperating straps of hook-and-vane cloth fastener. One of the upper corners of the flap cover is diagonally cut-away to expose a small part of the pocket opening, providing a convenient way to clip and quickly retrieve a pen or similar device.

5 Claims, 1 Drawing Sheet

VERSATILE GARMENT POCKET

FIELD OF THE INVENTION

This invention relates to garments, and more specifically to pockets used in work clothes and casual apparel.

BACKGROUND OF THE INVENTION

Working and traveling persons are prone to fill their shirts and coat pockets with items such as eyeglasses, and other often-used articles. Those articles have a tendency to become entangled with one another within the pocket and cannot easily be retrieved singly without causing one of the unselected articles to fall off the pocket. Some of those articles tend to slide out of the pocket if the person bends over unless they are secured by means of a clip as in the case of a pen. If the pocket is secured by a flap or a fastener, it becomes difficult to clip a pen or a similar device, and retrieve it quickly.

This invention results from an attempt to deal with the aforementioned inconveniences.

SUMMARY OF THE INVENTION

The principal and secondary objects of this invention are to provide a garment pocket that can securely hold a plurality of diverse objects without risk of entanglement. These and other valuable objects are achieved by means of a gusseted pocket having a flap cover that can be releasably closed by means of a hook-and-vane fastener wherein a cutout section of the flap cover allows for easy insertion of a pen or similar device along one edge of the pocket.

DESCRIPTION OF THE PREFERRED EMBODIMENT OF THE INVENTION

Figure 1:
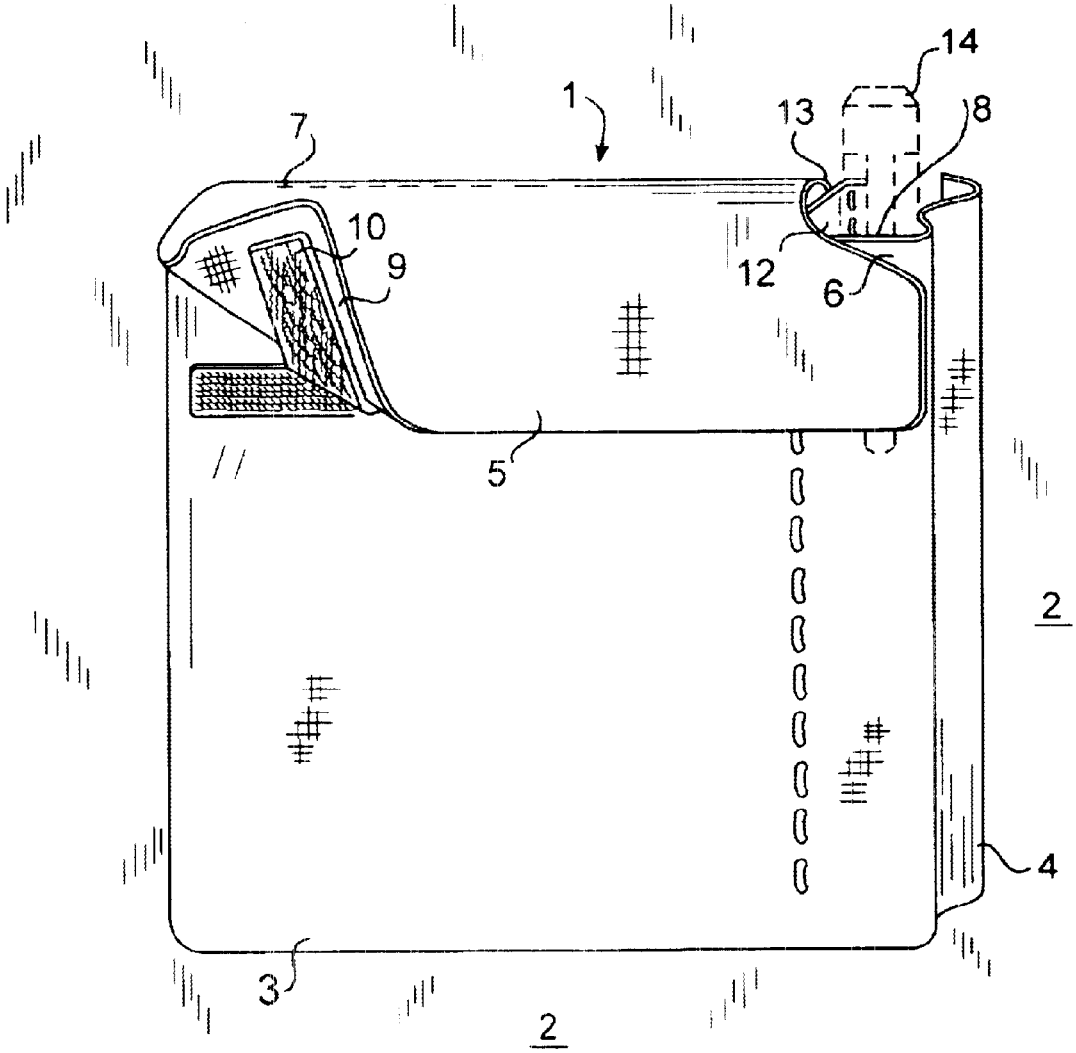
FIG. 1 is a perspective view of a garment pocket according to the invention.

Referring now to the drawing, there is shown a pocket 1 applicable to a portion 2 of a shirt or other garment. The pocket comprises a front sheet 3 of pliable material that is secured to a shirt portion 2 along two sides and the bottom by a length of pliable gusset 4. A flap cover 5 consisting of an oblong piece of the same pliable material, as a width substantially commensurate with that of the front sheet 3, and has one of the upper corners 6 cutaway.

The flap cover is stitched or otherwise secured along its reduced top edge 7 to the shirt portion along a line proximate and parallel to the top edge of the front sheet. A small section 8 of that top edge is permanently exposed by the cutaway portion 6 of the flap cover.

On the inner or under surface 9 of the flap cover, a first strip 10 of cloth fastener is permanently stitched or otherwise secured. A second strip 11 of cloth fastener capable of releasably bonding with the first strip, is secured to the outer face of the front sheet 3. The cloth fastener is preferably of the hook-and-vane type.

An internal gusset piece 12 stitched vertically between the front piece 3 and the shirt section 2 below the shortened end

13 of the flap cover top edge, forms a septum to separate any object such as pen 14 that may be introduced through the exposed end of the pocket from the contents of its largest portion.

Instead of using the gusset pieces 4, 12, the front sheet can be stitched directly to the portion 2 of the shirt.

While the preferred embodiments of the invention have been described, modifications can be made and other embodiments may be devised without departing from the spirit of the invention and the scope of the appended claims.

What is claimed is:

1. A garment pocket comprises:

a front sheet having top, bottom and opposite side edges;

said front sheet being adhered to said garment along said bottom and side edges, thereby forming a pocket having a top opening;

a flap sheet having top, bottom, and opposite sides extents;

said flap sheet being adhered to said garment along said top extent along a line proximate and parallel to said top edge of said front sheet;

wherein said line terminates a distance from a lateral terminus of said top edge; and thereby forming a cut-away portion of the flap sheet for exposing a section of said top edge while said flap is in a closed position;

means for releasably bonding said flap sheet to said front sheet;

wherein said means for releasably bonding comprise a first fabric fastener strip of a first type attached to an undersurface of said flap, and a second fabric fastener strip of a type complementary to said first type attached to an outer surface of said front sheet;

a septum dividing said pocket into first and second portions wherein said first portion has an opening uncovered by said flap while said flap is in a closed position.

2. The garment pocket of claim 1, wherein said front sheet is formed to have a gusset adjacent to said bottom and side edges.

3. A garment structure comprises:

a pocket having an opening;

a flap shaped, sized and positioned to partially cover said opening and have a cut-away portion for permanently exposing a section of said opening;

wherein said garment pocket further comprises:

a septum dividing said pocket into first and second portions wherein said first portion has an opening uncovered by said flap while said flap is in a closed position.

4. The garment pocket of claim 3 which further comprises means for releasably bonding said flap sheet to said front sheet.

5. The garment pocket of claim 4, wherein said means for releasably bonding comprise a first fabric fastener strip of a first type attached to an undersurface of said flap, and a second fabric fastener strip of a type complementary to said first type attached to an outer surface of said front sheet.

* * * * *